US008850999B1

(12) United States Patent
Kalkbrenner

(10) Patent No.: US 8,850,999 B1
(45) Date of Patent: Oct. 7, 2014

(54) SEWING MACHINE FEED DEVICE

(76) Inventor: Daniel K. Kalkbrenner, Fox River Grove, IL (US)

( * ) Notice: Subject to any disclaimer, the term of this patent is extended or adjusted under 35 U.S.C. 154(b) by 911 days.

(21) Appl. No.: 12/931,853

(22) Filed: Feb. 10, 2011

(51) Int. Cl.
*D05B 21/00* (2006.01)
*D05B 27/08* (2006.01)

(52) U.S. Cl.
CPC ..... *D05B 21/002* (2013.01); *D05B 27/08* (2013.01)
USPC ..... 112/470.18; 112/308; 112/324

(58) Field of Classification Search
CPC ..... D05B 21/002; D05B 27/08
USPC ..... 112/470.14, 470.17, 470.18, 308, 324
See application file for complete search history.

(56) References Cited

U.S. PATENT DOCUMENTS

| | | | | |
|---|---|---|---|---|
| 3,650,229 | A * | 3/1972 | Rovin | 112/470.03 |
| 3,693,561 | A * | 9/1972 | Hrinko et al. | 112/470.03 |
| 4,024,825 | A * | 5/1977 | Egtvedt et al. | 112/470.07 |
| 4,074,642 | A | 2/1978 | Herr | |
| 4,085,691 | A | 4/1978 | Coughenour et al. | |
| 4,092,938 | A | 6/1978 | Coughenour et al. | |
| 4,100,864 | A * | 7/1978 | Babson et al. | 112/470.01 |
| 4,191,118 | A * | 3/1980 | Blessing | 112/470.01 |
| 4,221,176 | A | 9/1980 | Besore et al. | |
| 4,286,532 | A | 9/1981 | Tonomura | |
| 4,467,737 | A | 8/1984 | Breck, Jr. | |
| 4,512,269 | A | 4/1985 | Bowditch | |
| 4,519,328 | A | 5/1985 | Takenoya et al. | |
| 4,593,636 | A * | 6/1986 | Schips | 112/308 |
| 4,682,553 | A * | 7/1987 | Bachmann et al. | 112/470.07 |
| 4,696,247 | A | 9/1987 | Horie | |
| 4,706,584 | A | 11/1987 | Senda et al. | |
| 4,730,824 | A * | 3/1988 | Huau et al. | 271/227 |
| 4,787,326 | A | 11/1988 | Scholl et al. | |
| 4,791,877 | A | 12/1988 | Horie et al. | |
| 4,817,543 | A | 4/1989 | Fischer | |
| 4,860,675 | A | 8/1989 | Brower et al. | |
| 4,867,082 | A | 9/1989 | Sabbioni et al. | |
| 4,876,976 | A | 10/1989 | Brower et al. | |
| 5,216,969 | A | 6/1993 | Thomas et al. | |
| 5,497,720 | A * | 3/1996 | Kawasaki | 112/153 |
| 5,582,122 | A | 12/1996 | Funderburk et al. | |
| 6,026,756 | A | 2/2000 | Frazer et al. | |
| 6,082,281 | A | 7/2000 | Root et al. | |
| 6,189,470 | B1 | 2/2001 | Root et al. | |
| 6,263,815 | B1 | 7/2001 | Furudate | |
| 6,945,185 | B2 | 9/2005 | Ribble et al. | |
| 7,401,563 | B2 * | 7/2008 | Sho | 112/308 |
| 7,444,951 | B2 * | 11/2008 | Ishikawa et al. | 112/475.04 |
| 7,520,230 | B2 | 4/2009 | Ribble et al. | |
| 7,597,059 | B2 | 10/2009 | Stutznacker | |
| 8,573,145 | B2 * | 11/2013 | Dickerson | 112/470.02 |
| 2008/0115710 | A1 * | 5/2008 | Ishikawa et al. | 112/470.17 |

* cited by examiner

*Primary Examiner* — Danny Worrell
(74) *Attorney, Agent, or Firm* — Mathew R. P. Perrone, Jr.

(57) ABSTRACT

A feed mechanism for a sewing machine, either separate from the rest of the machine or incorporated as a part thereof, to feed fabric in any direction, that is programmable, and is easily controlled.

17 Claims, 7 Drawing Sheets

SEWING MACHINE FEED DEVICE

This invention relates to a sewing machine feed device and, more particularly, to a sewing machine feed device separately driven from the rest of the sewing machine, which can feed the sewn product independently of the other sewing machine mechanisms and with a rotational component adapted so as to feed the fabric in any direction.

BACK GROUND OF THE MACHINE

In order to effectively use a sewing machine, it is very desirable to control the feeding of the fabric through the machine. To that end, many devices are known to assist this function. These devices primarily employ mechanisms mechanically arranged to achieve an elliptical motion of the fabric feeder. This elliptical motion results from a vertical motion imparted to the cloth feeder combined with a horizontal motion. The feeder rises up to engage the fabric and simultaneously starts moving the fabric horizontally. The vertical motion reaches its peak and begins to drop down as the horizontal motion continues to feed the fabric. When the feeder drops below the cloth support plate the fabric stops moving, the feeder continues down and starts returning horizontally. The fabric is held stationary during this return cycle by the clamping pressure of the presser foot. The feed returns to the start position and begins the vertical motion all over again, repeating the cycle.

The current mechanical feed mechanism incrementally moves the fabric in a straight line. The sewing machine operator must guide the fabric manually to achieve a curved stitch pattern. Also, in some sewn products, there could be a series of discreet areas to be sewn, not connected to each other. The operator must sew one area, stop, trim threads, reposition manually and start sewing the second area.

The current cloth feeding mechanisms are mechanically linked to the other sewing mechanisms (for example needle mechanism, hook mechanism, looper mechanisms, and so forth) to provide synchronous motions to produce a stitch. The prior art feed mechanism control features are also all mechanically arranged. Stitch length (the increment the fabric moves for each machine cycle) is adjusted by turning a dial to move a linkage, or by adjusting a mechanical eccentric, or by changing eccentric cams.

Better control of the fabric or material feeding through a sewing machine can greatly improve production and quality of sewn products. For the purposes herein fabric and material may be used interchangeably unless otherwise specified. To achieve this feeding with programmability and ease of control offers great advantages. Such features are currently unavailable in the art.

SUMMARY OF THE INVENTION

Among the many objectives of this invention is the provision of an improved sewing machine feed device to facilitate feeding fabric through a sewing machine.

An objective of this invention is a fabric feeding mechanism that is separately driven from the other mechanisms of a sewing machine.

A further objective of this invention is a fabric feeding mechanism that can transport the fabric in any direction.

A still further objective of this invention is a fabric feeding mechanism that is programmable.

Yet a further objective of this invention is a fabric feeding mechanism that has easy controls.

Also an objective of this invention is a fabric feeding mechanism that can produce a feed motion curve that is programmable.

Another objective of this invention is a fabric feeding mechanism that is capable of a programmable stitch length.

Still another objective of this invention is a fabric feeding mechanism that can produce a sewing path that is programmable.

Yet another objective of this invention is a fabric feeding mechanism that can feed the fabric with a "joystick" type control.

A further objective of this invention is a fabric feeding mechanism that can easily feed fabric in reverse (backtack).

A still further objective of this invention is a fabric feeding mechanism that can move fabric in a zig-zag pattern.

Yet a further objective of this invention is a fabric feeding mechanism that can be programmed to move fabric in a pattern to produce buttonholes.

A still further objective of this invention is a fabric feeding mechanism that can be programmed to move fabric in a pattern to produce eyelets.

Also an objective of this invention is a fabric feeding mechanism that can move fabric to do basting.

Another objective of this invention is a fabric feeding mechanism that can move fabric to do tacking.

Still another objective of this invention is a fabric feeding mechanism that can be adapted to a wide variety of sewing machines.

These and other objectives of the invention (which other objectives will become clear by consideration of the specifications, claims and drawings as a whole) are met by providing a feed mechanism for a sewing machine, either separate from the rest of the machine or incorporated as a part thereof, that will greatly improve quality of sewn products and increase production rates with less labor content.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
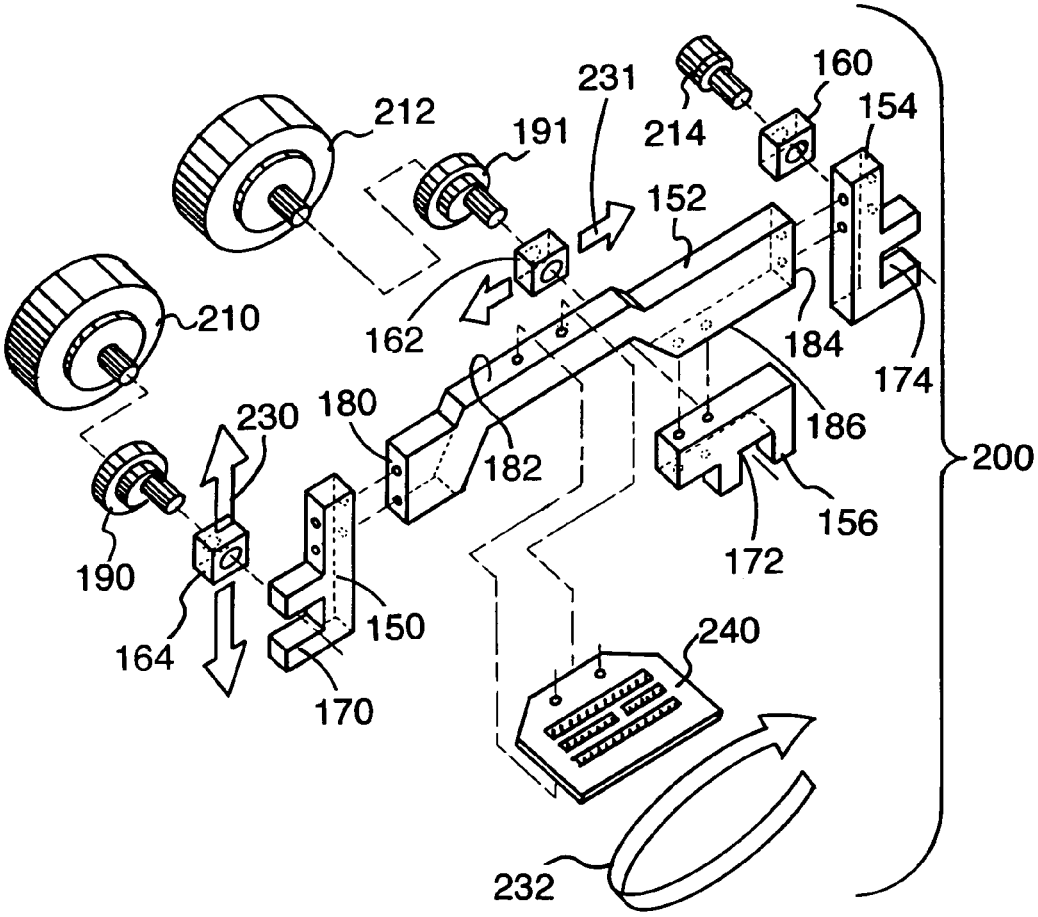
FIG. 1 depicts an exploded perspective view of the linear drive feature 200 for the sewing machine feed device 100 of this invention.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, over, above, below, beneath, rear, and front, may be used with respect to the drawings. These and similar to directional terms are not to be construed to limit the scope of the invention in any manner. The words attach, connect, couple, and similar terms with their inflectional morphemes do not necessarily denote direct or intermediate connections, but may also include connections through mediate elements or devices.

The feed mechanism for the sewing machine may be separate from the rest of the machine or incorporated as a part thereof. It can feed the fabric independent of the other sewing machine mechanisms and, with the addition of the rotational components of the feed mechanism, fabric can be fed in any direction. The feed dog moving in an elliptical path transports material over the throat plate. There are three computer controlled servo drive motors driving the feed mechanism: a vertical drive motor (feed lift), a horizontal drive motor (feed travel), and a rotational drive motor, all linked to a motor controller, a programming device/computer, and operator control panel/display. In the case of the rotational feed mechanism a "joy stick" type input device can be used to "steer" the fabric in any desired direction or path.

Typical sewing machines to which this feed mechanism can be adapted to include, but are not limited to: Lockstitch Machines—301 type stitch, Differential Feeds, Top Feeds, Feed-Off-Arm Type Machines, Chainstitch Machines—401 type stitch, Feed-Up-Arm Type Machines, Coverstitch Machines, Blindstitch Machines, Zig-Zag Machines, Overlock Machines (Sergers), Tackers, and Pattern Sewers.

Referring now to FIG. 1, the sewing machine feed mechanism 200 is provided by a grouping of parts including the feed bar 152. The feed lift bracket 150 communicates with the feed bar 152 at one end with pivot bracket 154 at the other end of feed bar 152. The feed travel bracket 156 is secured to the feed bar 152 adjacent to the pivot bracket 154.

First drive block 160 communicates with the pivot cradle 174 on pivot bracket 154. Second drive block 162 communicates with the feed travel drive block cradle 172 on the feed travel bracket 156. Then third drive block 164 communicates with feed lift drive block cradle 170 on the feed lift bracket 150. Thus, front end 180 of feed bar 152 supports the feed lift bracket 150. The top end 182 of feed bar 152 receives the feed dog 240. The back end 184 of feed bar 152 has a pivot bracket 154 secured thereto. The bottom side 186 of feed bar 152 has feed travel bracket 156 secured thereto.

The feed lift eccentric 190 communicates with third drive block 164 and is driven by feed lift servo motor 210. The feed travel eccentric 191 communicates with second drive block 162 and is driven by feed travel servo motor 210. Pivot pin 214 cooperates with first drive block 160. This structure provides cooperation between vertical feed lift motion 230 of third drive block 164 and horizontal feed travel motion 234 of drive block 162. Elliptical motion 232 of the feed dog 240 on the feed bar 152 occurs when the feed lift servo motor 210 and the feed travel servo motor 212 are rotated in conjunction.

The vertical or feed lift servo motor 210, and horizontal servo drive motor or feed travel servo motor 212 are capable of being programmed to achieve an elliptical motion. In addition, the motors can be programmed to achieve non-elliptical feed motions. For example, the feed motion could rise slowly vertically so as to reduce damage to the fabric, then move horizontally and retract down quickly and return horizontally quickly.

Also, the feed motion stitch length can be programmed by adjusting the time span for the vertical motion or by advancing the vertical motion partially and then retracting (partial rotation of the motor). The motors can also be programmed to do reverse feeding simply by changing the timing of when the vertical motion is activated relative to the horizontal motor. The "tacking" operation can be done with this type of sewing machine feed mechanism by simply programming the motors to move the fabric forward one stitch length and back one stitch length for a set number of sewing machine cycles.

And finally, this feed mechanism with separately driven motors can feed the fabric while not sewing. This can be used to achieve any desired stitch length for example by feeding the fabric 10 increments, sewing one stitch, and feeding the fabric again 10 increments and sewing one stitch, the effect is a long stitch length. This can be used to do "basting" where one or several stitches are put into a sewn product to temporarily hold pieces together. This is done in a number of areas that could now be programmed into a pattern where the product is moved automatically to the various points where basting is done without operator involvement.

Figure 2:
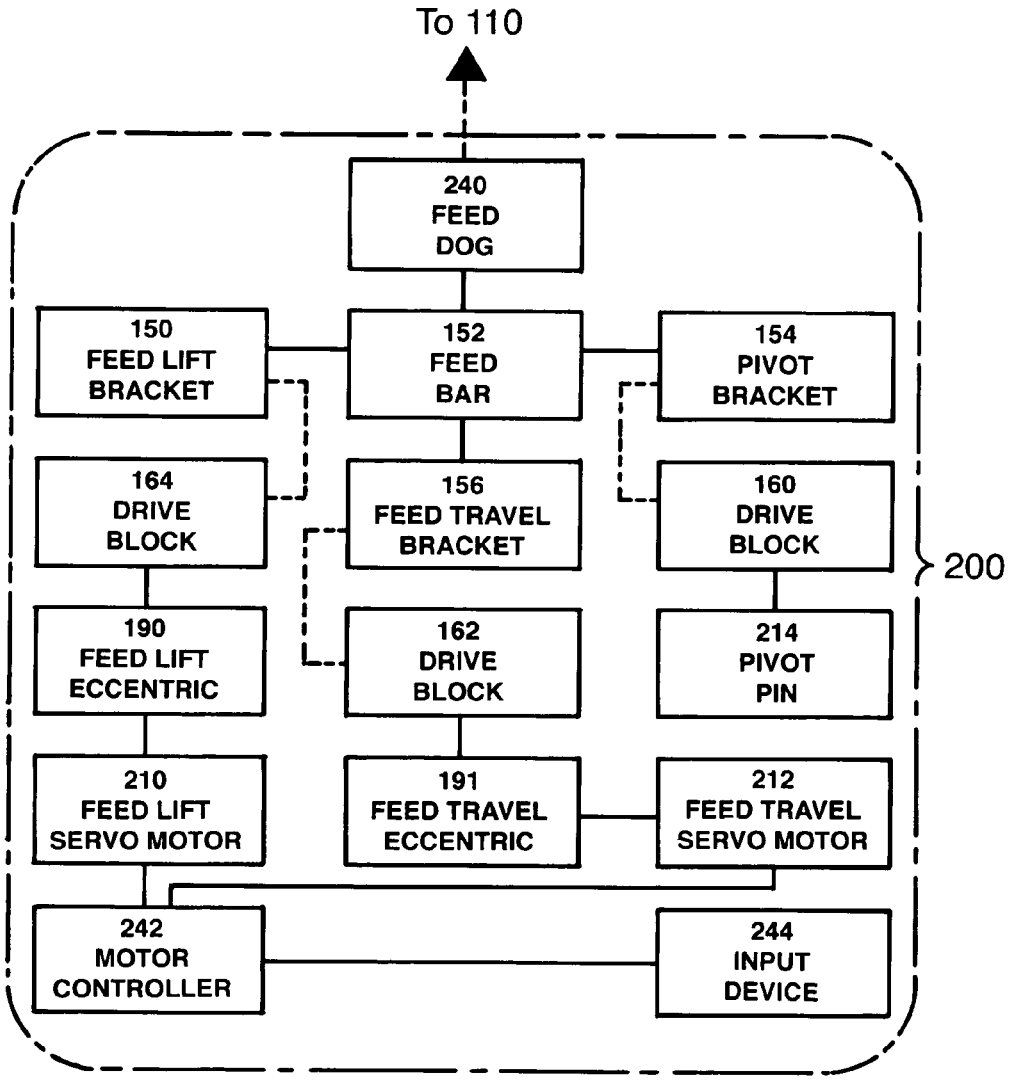
FIG. 2 depicts a block diagram of the linear drive feature 200 for the sewing machine feed device 100 of this invention.

In FIG. 2, the linear drive feature 200 is further explained in block diagram form as connecting to needle plate 110. More particularly feed dog 240 communicates with needle plate 110. Feed dog 240 also communicates with feed bar 152. Feed bar 152 is connected to feed lift bracket 150, pivot bracket 154, feed travel bracket 156. Feed lift bracket 150 is connected to third drive block 164. Third drive block 164 is connected to feed lift eccentric 190. Feed lift eccentric 190 is operated by feed lift servo motor 210. Feed lift servo motor 210 is connected to motor controller 242. Input device 244 is connected to motor controller 242. Also, feed bar 152 is connected to feed travel bracket 156. Feed travel bracket 156 cooperates with second drive block 164, which in turn is connected to feed travel eccentric 191. Feed travel eccentric 191 is operated by feed travel servo motor 212, which in turn, is connected to motor controller 242. Also, pivot bracket 154 cooperates with first drive block 160 as mounted on pivot pin 214.

Figure 3:
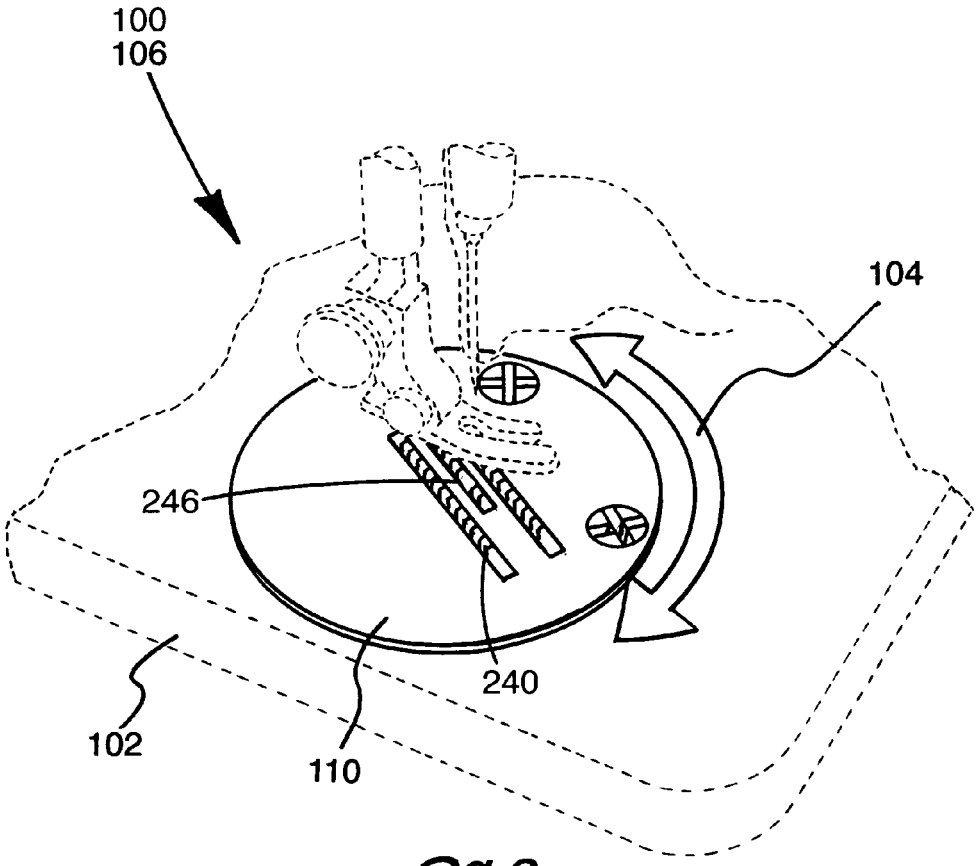
FIG. 3 depicts a top perspective view of the sewing machine feed device 100 with sewing machine 102 in phantom.

Referring to FIG. 3, sewing machine feed device 100 is positioned on sewing machine 102 under a right turn indicator 104 where needle plate 110 rotates. The feed device 200 and the rotation feature 106 provides a fabric transport method through the sewing machine 102 that is programmable, that can feed fabric in any direction and that is readily controllable and flexible.

Figure 4:
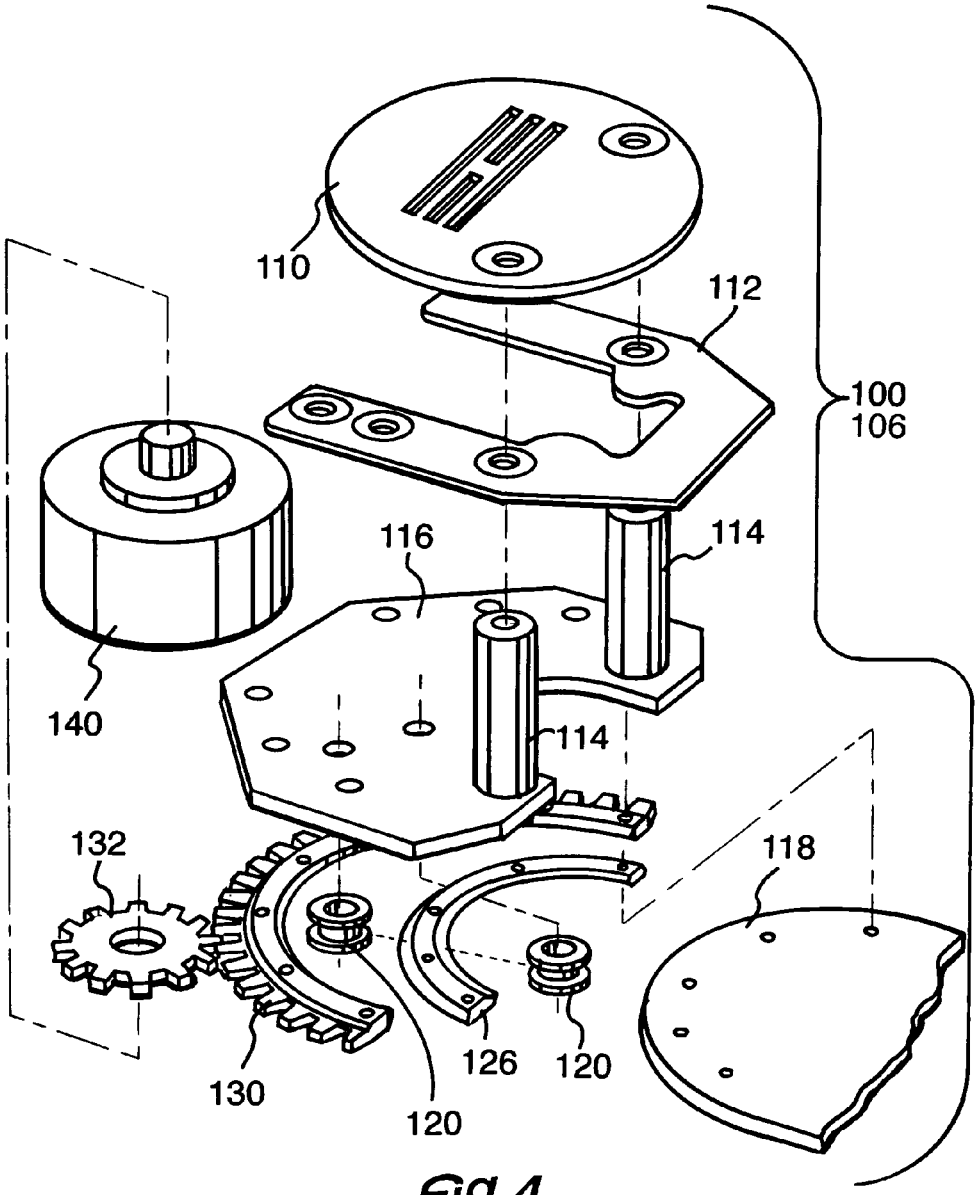
FIG. 4 depicts an exploded perspective view of the sewing machine feed device 100 of this invention with rotation feature 106.

Adding FIG. 4 to the consideration, rotation feature 106 is depicted. Needle plate 110 is connected to support plate 112. Support plate 112 is supported by two of support post 114. Support post 114, are attached to rotation base plate 116. Rotation base plate 116 supports two sets of grooved rollers 120. Two sets of grooved rollers 120 roll on each side of guide rail 126. Guide rail 126 is attached to rail support plate 118.

Segment gear 130 is attached to rotation plate 116 and meshes with pinion gear 132. Pinion gear 132 is operated by rotation servo motor 140. Rotation servo motor 140 is in turn operated by motor controller 242. Input device 244 feeds information to motor controller 242 to control servo motor 140. Input device 244 and motor controller 242 may be joint or separate devices.

Input device 244 may be a joy stick, a computer or other appropriate device. With such a structure, the elliptical type motion 232 of FIG. 1 may be adjusted to any desired shape. The structure of motor controller 242 and input device 244 may be applied to the feed lift servo motor 210 or the feed travel servo motor 212 of FIG. 1 or any other servo motor herein.

Figure 5:
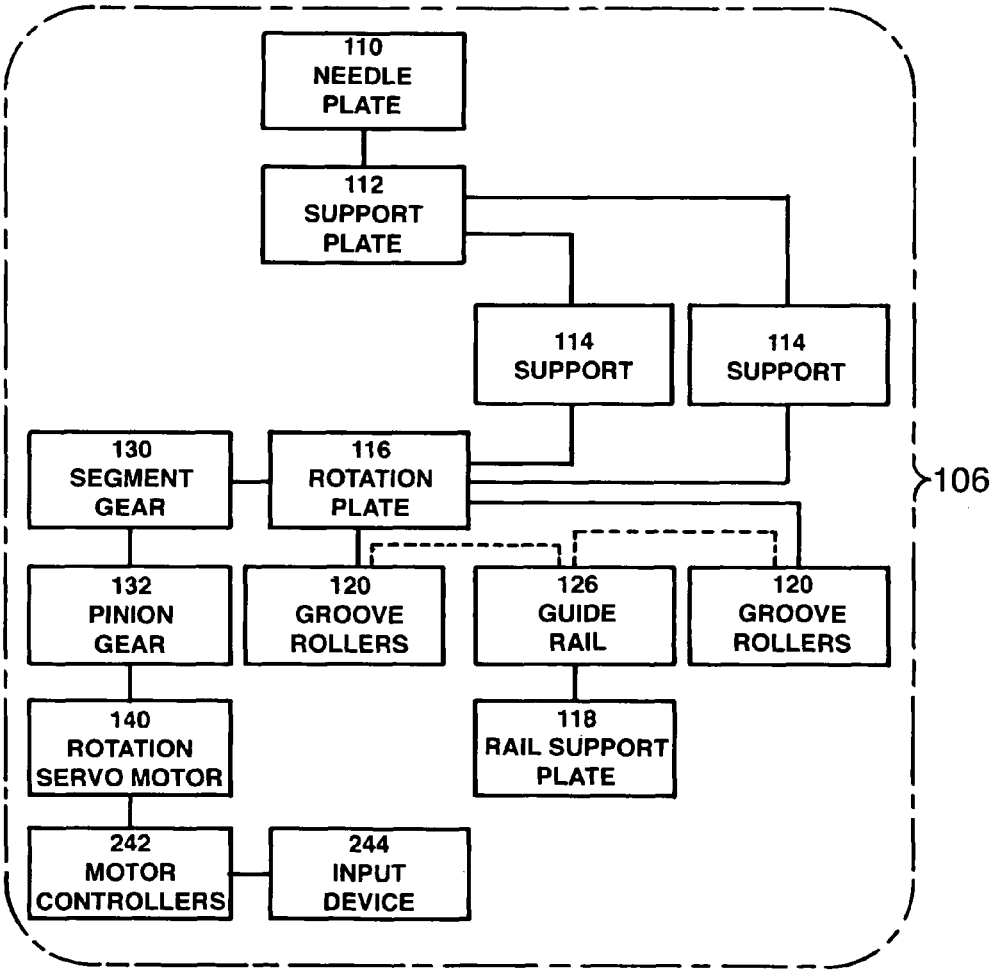
FIG. 5 depicts a block diagram of rotation feature 106 for the sewing machine feed device 100 of this invention.

In FIG. 5, rotational feature 106 is depicted in block diagram form. Needle plate 110 is mounted to support plate 112 which sits on a pair of support posts 114. Support posts 114 provide connection between support plate 112 and rotational base plate 116. Two sets of grooved rollers 120 are attached to rotation plate 116. The grooved rollers ride on each side of guide rail 126. And guide rail 126 is mounted to rail support plate 118. Also mounted to rotation plate 116 is segment gear 130. Pinion gear 132 engages segment gear 130 and is driven by rotation servo motor 140. The rotation servo motor is then connected to motor controller 242. Input device 244 then connects to the motor controller 242. Rotational servo motor 140, mounted in this structure, permits efficient feeding of material through a sewing machine.

With the rotational feature 106, the feed mechanism can now feed the fabric in any direction. With the feed dogs in the down position the needle plate is rotated by the rotational servo motor so that the feed dogs are pointing in the desired direction. When the feed dogs are on the vertical portion of their elliptical path they engage the fabric and then move the fabric horizontally in the direction set by the rotational motor. The feed dogs then retract down, the rotational motor repositions to the next desired direction and the cycle repeats. The fabric must be held stationary by the presser foot during the needle plate rotation. By a combination of programming the rotational motor with the forward and reverse directions of the horizontal and vertical motors any fabric direction can be achieved.

The control of the fabric movement can be accomplished with a joystick. A joystick is an input device consisting of a stick that pivots on a base and reports it angle or direction to the device it is controlling. The left, right, forward, and backward motion of the fabric could be controlled with a joystick.

The fabric motion can also follow a programmed path. The location of each stitch can be inputted into a computer and stored. Various programs can then be called up and used to drive the fabric feed mechanism and sewing machine to produce an infinite variety of paths, curves, and patterns.

Figure 6:
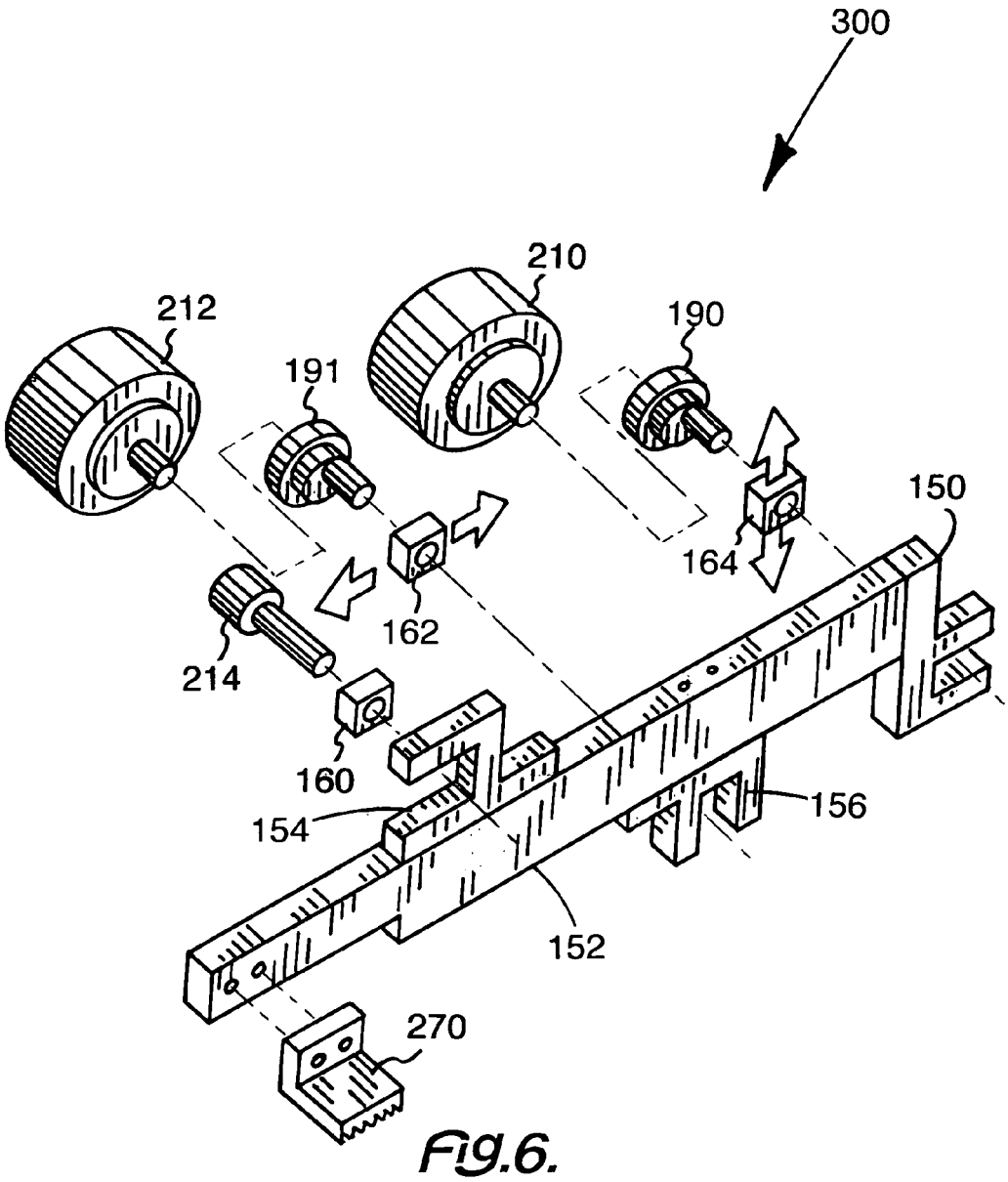
FIG. 6 depicts an exploded perspective view of a second sewing machine feed device 300 for the sewing machine feed device 100 of this invention.

FIG. 6 depicts another embodiment of a sewing machine feed mechanism with second sewing machine feed device 300. This top feed arrangement can be incorporated into a typical blindstitch machine. In this case, the feed dog 270 grips the fabric from the top. The primary feed dog 270 again moves in an elliptical motion driven by the vertical servo motor or feed lift servo motor 210 and its eccentric 190 and first drive block 160 and the horizontal servo motor or the feed travel servo motor 212 and its eccentric 191 and second drive block 162. The primary feed dog 270 may also grip the fabric from the top and pulls the fabric through the sewing machine 102. Pivot pin 214 works to hold first drive block 160 in position pivot bracket 154 of motion bracket 152. Feed travel bracket 156 of motion bracket 152 receives second drive block 162. Feed lift bracket 150 of motion bracket 152 receives third drive block 164. This structure permits feed dog 270 to operate efficiently.

Figure 7:
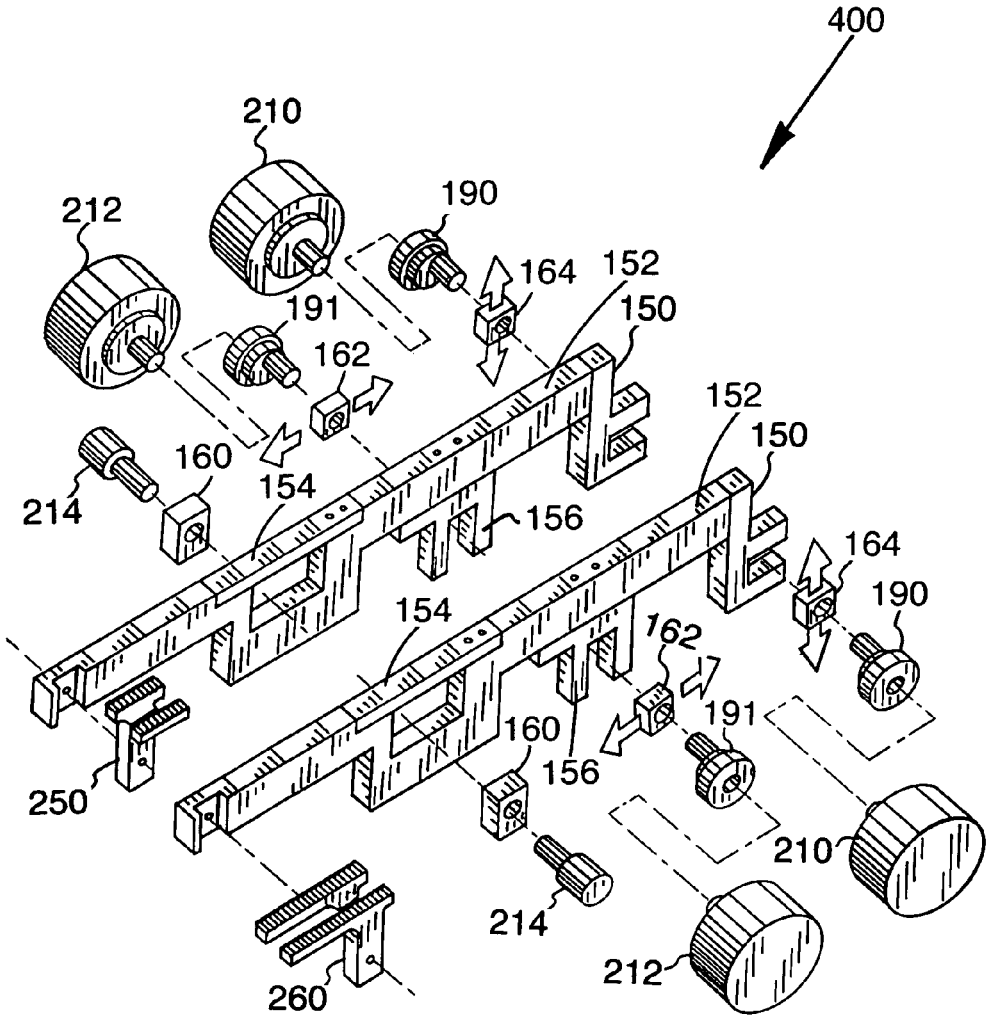
FIG. 7 depicts an exploded perspective view of a third sewing machine feed device 400 for the sewing machine feed device 100 of this invention.

FIG. 7 depicts an exploded perspective view of a third embodiment for a linear differential feed mechanism, feed device 400. In this case there are two feed mechanisms placed side-by-side such that the first feed dog 250 is behind the second feed dog 260. The motors can be programmed so that the first feed dog 250 can move a greater horizontal distance than the second feed dog 260 resulting in stretching the fabric. When the first feed dog 250 is programmed to move a lesser horizontal distance than the second feed dog 260 the fabric 110 is gathered as desired. Having the capability to program when the fabric is to be gathered or stretched can be important when sewing knit materials that act differently when pulled in different directions.

Each of feed dog 250 or 260 is driven vertically by its own feed lift servo motor 210 with eccentric 190 and first drive block 160 and horizontally by its own feed travel servo motor 212 with eccentric 191 and second drive block 162. Each pivot pin 214 works to hold first drive block 160 in position pivot bracket 154 of motion bracket 152. Feed travel bracket 156 of motion bracket 152 receives second drive block 162. And feed bracket 150 of motion bracket 152 receives third drive block 164.

This application, taken as a whole with abstract, specification, claims, and drawings being combined, provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A sewing machine feed device to cooperate with a sewing machine and feed a fabric in a desired direction comprising:

a) a driving means for the sewing machine feed device being separately drivable in relation to the sewing machine;

b) a feed mechanism feeding a sewn product independently of the sewing machine;

c) a rotational component being adapted to feed a material to a sewing in a desired direction;

d) the feed mechanism for the sewing machine being separate from the sewing machine or incorporated as a part thereof;

e) at least one rotational component for the feeding mechanism feeding a material in the desired direction;

f) the feed mechanism including at least one feed dog;

g) the at least one feed dog moving in an elliptical path to transport the material over a throat plate;

h) the feed mechanism including a vertical drive motor, a horizontal drive motor, and a rotational drive motor;

i) a motor controller being cooperatively connected to the vertical drive motor, the horizontal drive motor, and the rotational drive motor;

j) a programming device being cooperatively connected to the vertical drive motor, the horizontal drive motor, and the rotational drive motor; and k) an operator control panel being cooperatively connected to the vertical drive motor, the horizontal drive motor, and the rotational drive motor.

2. The sewing machine feed device of claim 1 further comprising:

a) a joy stick input device operating the rotational drive motor component to steer the material as desired;

b) the sewing machine feed device including a feed bar;

c) a feed lift bracket communicating with the feed bar at a first bracket end;

d) the feed lift bracket communicating with the feed bar at a second bracket end;

e) the first bracket end being oppositely disposed from the second bracket end; and f) a feed travel bracket being secured to the feed bar adjacent to the pivot bracket.

3. The sewing machine feed device of claim 2 further comprising:

a) the rotational drive motor component including a first drive block, a second drive block and a third drive block;

b) the first drive block communicating with a pivot cradle on a pivot bracket;

c) the second drive block communicating with a feed travel drive block cradle on a feed travel bracket;

d) the third drive block communicating with a feed lift drive block cradle on a feed lift bracket;

e) a front end of the feed bar supporting the feed lift bracket;

f) a top end of the feed bar receiving the feed dog;

g) a back end of the feed bar having the pivot bracket secured thereto; and h) a bottom side of the feed bar having the feed travel bracket secured thereto.

4. The sewing machine feed device of claim 3 further comprising:

a) a feed lift eccentric communicating with the first drive block and being driven by a feed lift servo motor;

b) a feed travel eccentric communicating with the second drive block and being driven by a feed travel servo motor;

c) a pivot pin cooperating with the first drive block to provide cooperation between a vertical feed lift motion of the third drive block and a horizontal feed travel motion of the second drive block;

d) an elliptical motion being impart to the feed dog on the feed bar as the feed lift servo motor and the feed travel servo motor are rotated in conjunction.

5. The sewing machine feed device of claim 4 further comprising:

a) the feed lift servo motor being a vertical servo drive motor;

b) the feed travel servo motor being a horizontal servo drive motor; and c) the vertical servo drive motor and the feed travel servo motor being programmable to achieve an elliptical feed motion or a non-elliptical feed motion.

6. The sewing machine feed device of claim 5 further comprising:

a) the feed motion being slow to reduce damage to the fabric;

b) then feed motion being adjustable to affect stitch length can be programmed by adjusting the time span of the vertical motion or by advancing the vertical motion partially and then retracting the same.

7. The sewing machine feed device of claim 6 further comprising:

a) the vertical servo drive motor and the feed travel servo motor being programmable to achieve reverse feeding by changing the timing of when the vertical motion is activated relative to the horizontal motor;

b) a tacking operation being accomplished by programming the vertical servo drive motor and the feed travel servo motor to move the fabric forward one stitch length and back one stitch length for a set number of sewing machine cycles; and c) a basting operation being accomplished by programming the feed mechanism to feed the fabric for a long period.

8. The sewing machine feed device of claim 7 further comprising:

a) a third programmable servo motor feeding fabric in a selected direction or pattern;

b) the sewing machine feed device including a needle plate;

c) the needle plate being positioned on the sewing machine under a right turn indicator in order to feed the fabric in the desired direction in a controllable or flexible flexible;

d) the needle plate being mounted over a support plate; and e) the support plate sitting on a first support post and a second support post.

9. The sewing machine feed device of claim 8 further comprising:

a) the first support post and the second support post providing a connection between the support plate and a rotational base plate;

b) a rail support plate being below the rotational base plate;

c) a guide rail being mounted between the rotational base plate and rail support plate;

d) the guide rail being to secured to the support plate;

e) a set of grooved rollers being secured to the rotational base plate;

f) the set of grooved rollers receiving the guide rail;

g) a segment gear being secured to the rotational base plate;

h) the segment gear meshing with a pinion gear; and i) the pinion gear being mounted on the rotational servo motor.

10. The sewing machine feed device of claim 9 further comprising:

a) the set of grooved rollers being four in number; and b) the set of grooved rollers being positioned on opposing sides of the guide rail.

11. In a sewing machine, the improvement comprising:

a) a feed device cooperating with the sewing machine to feed a fabric in a desired direction;

b) a driving means for the feed device being separately drivable in relation to the sewing machine;

c) a feed mechanism feeding a sewn product independently of the sewing machine;

d) a rotational component being adapted to feed a material to a sewing in a desired direction;

e) the feed mechanism for the sewing machine being separate from the sewing machine or incorporated as a part thereof;

f) at least one rotational component for the feeding mechanism feeding a material in the desired direction;

g) the feed mechanism including at least one feed dog;

h) the at least one feed dog moving in an elliptical path to transport the material over a throat plate;

i) the feed mechanism including a vertical drive motor, a horizontal drive motor, and a rotational drive motor;

j) a motor controller being cooperatively connected to the vertical drive motor, the horizontal drive motor, and the rotational drive motor; and k) a programming device being cooperatively connected to the vertical drive motor, the horizontal drive motor, and the rotational drive motor.

12. The sewing machine of claim 11 further comprising:

a) a programming device being cooperatively connected to the vertical drive motor, the horizontal drive motor, and the rotational drive motor;

b) an operator control panel being cooperatively connected to the vertical drive motor, the horizontal drive motor, and the rotational drive motor;

c) a joy stick input device operating the rotational drive motor component to steer the material as desired;

d) the sewing machine feed device including a feed bar;

e) a feed lift bracket communicating with the feed bar at a first bracket end;

f) the feed lift bracket communicating with the feed bar at a second bracket end;

g) the first bracket end being oppositely disposed from the second bracket end;

h) a feed travel bracket being secured to the feed bar adjacent to the pivot bracket;

i) the rotational drive motor component including a first drive block, a second drive block and a third drive block;

j) the first drive block communicating with a pivot cradle on a pivot bracket; and k) the second drive block communicating with a feed travel drive block cradle on a feed travel bracket.

13. The sewing machine of claim 12 further comprising:

a) the third drive block communicating with a feed lift drive block cradle on a feed lift bracket;

b) a front end of the feed bar supporting the feed lift bracket;

c) a top end of the feed bar receiving the feed dog;

d) a back end of the feed bar having the pivot bracket secured thereto;

e) a bottom side of the feed bar having the feed travel bracket secured thereto;

f) a feed lift eccentric communicating with the first drive block and being driven by a feed lift servo motor;

g) a feed travel eccentric communicating with the second drive block and being driven by a feed travel servo motor;

h) a pivot pin cooperating with the first drive block to provide cooperation between a vertical feed lift motion of the third drive block and a horizontal feed travel motion of the second drive block;

i) an elliptical motion being impart to the feed dog on the feed bar as the feed lift servo motor and the feed travel servo motor are rotated in conjunction;

j) the feed lift servo motor being a vertical servo drive motor;

k) the feed travel servo motor being a horizontal servo drive motor; and l) the vertical servo drive motor and the feed travel servo motor being programmable to achieve an elliptical feed motion or a non-elliptical feed motion.

14. The sewing machine of claim 13 further comprising:

a) the feed motion being slow to reduce damage to the fabric;

b) then feed motion being adjustable to affect stitch length can be programmed by adjusting the time span of the vertical motion or by advancing the vertical motion partially and then retracting the same;

c) the vertical servo drive motor and the feed travel servo motor being programmable to achieve reverse feeding by changing the timing of when the vertical motion is activated relative to the horizontal motor;

d) a tacking operation being accomplished by programming the vertical servo drive motor and the feed travel servo motor to move the fabric forward one stitch length and back one stitch length for a set number of sewing machine cycles;

e) a basting operation being accomplished by programming the feed mechanism to feed the fabric for a long period;

f) a third programmable servo motor feeding fabric in a selected direction or pattern;

g) the sewing machine feed device including a needle plate;

h) the needle plate being positioned on the sewing machine under a right turn indicator in order to feed the fabric in the desired direction in a controllable or flexible manner; and i) the needle plate being mounted over a support plate.

15. The sewing machine of claim 14 further comprising:

a) the support plate sitting on a first support post and a second support post;

b) the first support post and the second support post providing a connection between the support plate and a rotational base plate;

c) a rail support plate being below the rotational base plate;

d) a guide rail being mounted between the rotational base plate and rail support plate;

e) the guide rail being to secured to the support plate;

f) a set of grooved rollers being secured to the rotational base plate;

g) the set of grooved rollers receiving the guide rail;

h) a segment gear being secured to the rotational base plate;

i) the segment gear meshing with a pinion gear;

j) the pinion gear being mounted on the rotational servo motor;

k) the set of grooved rollers being four in number; and l) the set of grooved rollers being positioned on opposing sides of the guide rail.

16. The sewing machine of claim 15 being selected from the group consisting of a lockstitch machine, a type stitch, a differential feed, a top feed, a feed-off-arm type machine, a chainstitch machine, a 401 type stitch, a feed-up-arm type machine, a coverstitch machine, a blindstitch machine, a zigzag machine, an overlock machine (sergers), a tacker, and a pattern sewer.

17. A method for controlling the fabric feed to a sewing machine comprising:

a) providing a feed device to cooperate with the sewing machine and feed a fabric in a desired direction;

b) providing a driving means for the feed device separately drivable in relation to the sewing machine;

c) providing a feed mechanism to feeding a sewn product independently of the sewing machine;

d) providing a rotational component adapted to feed a material to a sewing in a desired direction;

e) providing the feed mechanism for the sewing machine separate from the sewing machine or incorporated as a part thereof;

f) providing at least one feed dog for the feed mechanism to feed the material as desired;

g) the feed mechanism having a first feed dog and a second feed dog;

h) the first feed dog being activated separately from the second feed dog; and i) the first feed dog and the second feed dog serving to gather or stretch the fabric.

* * * * *